US008424863B2

(12) United States Patent
Kita et al.

(10) Patent No.: US 8,424,863 B2
(45) Date of Patent: Apr. 23, 2013

(54) PAPER FEEDER AND IMAGE FORMING APPARATUS

(75) Inventors: Nobuhiko Kita, Osaka (JP); Sei Onuma, Osaka (JP); Ryoh Idehara, Hyogo (JP); Kazuyoshi Kondo, Osaka (JP); Yuusuke Furuichi, Osaka (JP); Genta Hagiwara, Ibaraki (JP); Kaoru Tada, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/137,367

(22) Filed: Aug. 9, 2011

(65) Prior Publication Data

US 2011/0298171 A1 Dec. 8, 2011

Related U.S. Application Data

(62) Division of application No. 12/003,304, filed on Dec. 21, 2007, now Pat. No. 8,020,848.

(30) Foreign Application Priority Data

Dec. 25, 2006 (JP) ..... 2006-347158
Oct. 2, 2007 (JP) ..... 2007-258248

(51) Int. Cl.
*B65H 5/26* (2006.01)
*B65H 7/02* (2006.01)

(52) U.S. Cl.
USPC ..... 271/9.03; 271/265.01

(58) Field of Classification Search ..... 271/9.02, 271/9.03, 265.01, 265.02, 258.01, 258.05
See application file for complete search history.

(56) References Cited

U.S. PATENT DOCUMENTS

| | | | | | |
|---|---|---|---|---|---|
| 4,974,019 | A | * | 11/1990 | Nishioka et al. | 399/23 |
| 5,155,537 | A | * | 10/1992 | Komatsu et al. | 399/391 |
| 5,168,316 | A | * | 12/1992 | Hino et al. | 399/23 |
| 5,299,795 | A | * | 4/1994 | Miyake | 271/9.02 |
| 5,347,350 | A | * | 9/1994 | Nakahata et al. | 399/23 |
| 5,523,822 | A | * | 6/1996 | Tsuda | 399/13 |
| 7,377,506 | B2 | * | 5/2008 | Miyajima | 271/9.03 |
| 2004/0061283 | A1 | * | 4/2004 | Hyun | 271/265.01 |
| 2007/0110475 | A1 | | 5/2007 | Idehara et al. | |

FOREIGN PATENT DOCUMENTS

| | | | |
|---|---|---|---|
| JP | 63071048 | * | 3/1988 |
| JP | 05-000740 | | 1/1993 |
| JP | 07-149452 | | 6/1995 |
| JP | 07149452 | * | 6/1995 |
| JP | 2542064 | | 7/1996 |
| JP | 11-199092 | | 7/1999 |
| JP | 11-240648 | | 9/1999 |

* cited by examiner

*Primary Examiner* — Patrick Cicchino
(74) *Attorney, Agent, or Firm* — Harness, Dickey & Pierce, P.L.C.

(57) ABSTRACT

In a paper feeder, a signal switching unit switches a paper present signal output from a paper detector to a paper absent signal indicative of absence of a paper in the second paper cassette if a first paper cassette is pulled out from a specific position.

6 Claims, 7 Drawing Sheets

FIG. 12

| PRESENCE OR ABSENCE OF PAPER IN SECOND PAPER CASSETTE (OUTPUT SIGNAL OF TRANSMISSION-TYPE PHOTOSENSOR 13) | PRESENCE OR ABSENCE OF FIRST PAPER CASSETTE (OUTPUT SIGNAL OF TRANSMISSION-TYPE PHOTOSENSOR 17) | OUTPUT FROM AND CIRCUIT |
|---|---|---|
| NO PAPER | NO PAPER | DISABLE SHEET FEEDING |
| NO PAPER | PAPER LOADED | DISABLE SHEET FEEDING |
| PAPER LOADED | NO PAPER | DISABLE SHEET FEEDING |
| PAPER LOADED | PAPER LOADED | ENABLE SHEET FEEDING |

PAPER FEEDER AND IMAGE FORMING APPARATUS

CROSS-REFERENCE TO RELATED APPLICATIONS

This U.S. non-provisional application claims priority under 35 U.S.C. §120/121 to and is a divisional of U.S. application Ser. No. 12/003,304, filed Dec. 21, 2007 now U.S. Pat. No. 8,020,848, which claims priority under 35 U.S.C. §119 to Japanese Patent Application No. 2006-347158 filed on Dec. 25, 2006 in the Japanese Intellectual Property Office, and to Japanese Patent Application No. 2007-258248 filed on Oct. 2, 2007 in the Japanese Intellectual Property Office, the entire contents of each of which is hereby incorporated herein by reference.

BACKGROUND OF THE INVENTION

1. Field of the Invention

The present invention relates to a paper feeder for an image forming apparatus.

2. Description of the Related Art

Some paper feeders for image forming apparatuses each are provided with a first paper cassette and a second paper cassette located upstream of the first paper cassette in a paper feed path and configured to transport paper fed from the second paper cassette along a paper guide formed by utilizing a portion of the shape of the first paper cassette downstream of the second paper cassette. Such a paper feeder has the following problem: when the first paper cassette is pulled out before a sheet has been transported from the second paper cassette, absence of the paper guide can cause the sheet to fail to pass through the second paper cassette, and eventually a paper jam.

As techniques for preventing such a paper jam, the following methods have been proposed: a method of causing a locking mechanism utilizing a solenoid to prevent the first paper cassette from being pulling out (Japanese Patent No. 2542064); a method of, when the first paper cassette is pulled out to replace paper, rotating another paper guide mechanism (auxiliary paper guide) to thereby set a paper transport path formed with the auxiliary paper guide in place of a paper transport path formed with the first paper cassette (Japanese Patent Application Laid-open No. H5-740); and a method of, when a detecting mechanism detects that the first paper cassette is removed, a central processing unit (CPU) stops sheet feeding from the second paper cassette (Japanese Patent Application Laid-open No. H11-240648).

However, any one of the methods of the conventional art is disadvantageous in that the number of parts increases due to the additional locking mechanism, paper guide mechanism, or detecting mechanism, which increases manufacturing cost.

SUMMARY OF THE INVENTION

It is an object of the present invention to at least partially solve the problems in the conventional technology.

According to an aspect of the present invention, there is provided a paper feeder including a first paper cassette where paper can be stacked, the first paper cassette configured to be set at a specific position; a second paper cassette located upstream of the first paper cassette in a paper feed path and where paper can be stacked; a paper detector that detects whether paper is present in the second paper cassette and outputs a paper present signal upon detecting presence of a paper in the second paper cassette; and a signal switching unit configured to switch a paper present signal output from the paper detector to a paper absent signal indicative of absence of a paper in the second paper cassette, wherein, if the first paper cassette is pulled out from the specific position, the signal switching unit switches a paper present signal to a paper absent signal irrespective of presence or absence of paper in the second paper cassette.

According to another aspect of the present invention, there is provided a paper feeder including a first paper cassette where paper can be stacked, the first paper cassette configured to be set at a specific position; a cassette detecting member configured to be displaced depending on whether the first paper cassette is in the specific position; a second paper cassette located upstream of the first paper cassette in a paper feed path and where paper can be stacked; a paper detecting member configured to be displaced in accordance with number of papers stacked in the second paper cassette; and a displacement detecting sensor configured to detect amounts of displacement of the cassette detecting member and the paper detecting lever.

According to still another aspect of the present invention, there is provided an image forming apparatus that includes the above paper feeder.

According to still another aspect of the present invention, there is provided an image forming apparatus including a first paper cassette supported on an image-forming-apparatus main body in a manner that allows the first paper cassette to be pulled out from a specific position; and an additional paper-feed unit that can be connected to a lower portion of the image-forming-apparatus main body. A cassette detector provided on the additional paper-feed unit detects whether the first paper cassette is in the specific position when the additional paper-feed unit is connected to the image-forming-apparatus main body.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 12 is a table of a logic according to which two output signals of sensors in the paper feeder according to the third embodiment are converted into a signal.

DETAILED DESCRIPTION OF THE PREFERRED EMBODIMENTS

Exemplary embodiments of the present invention will be explained below in detail with reference the accompanying drawings.

Figure 1:
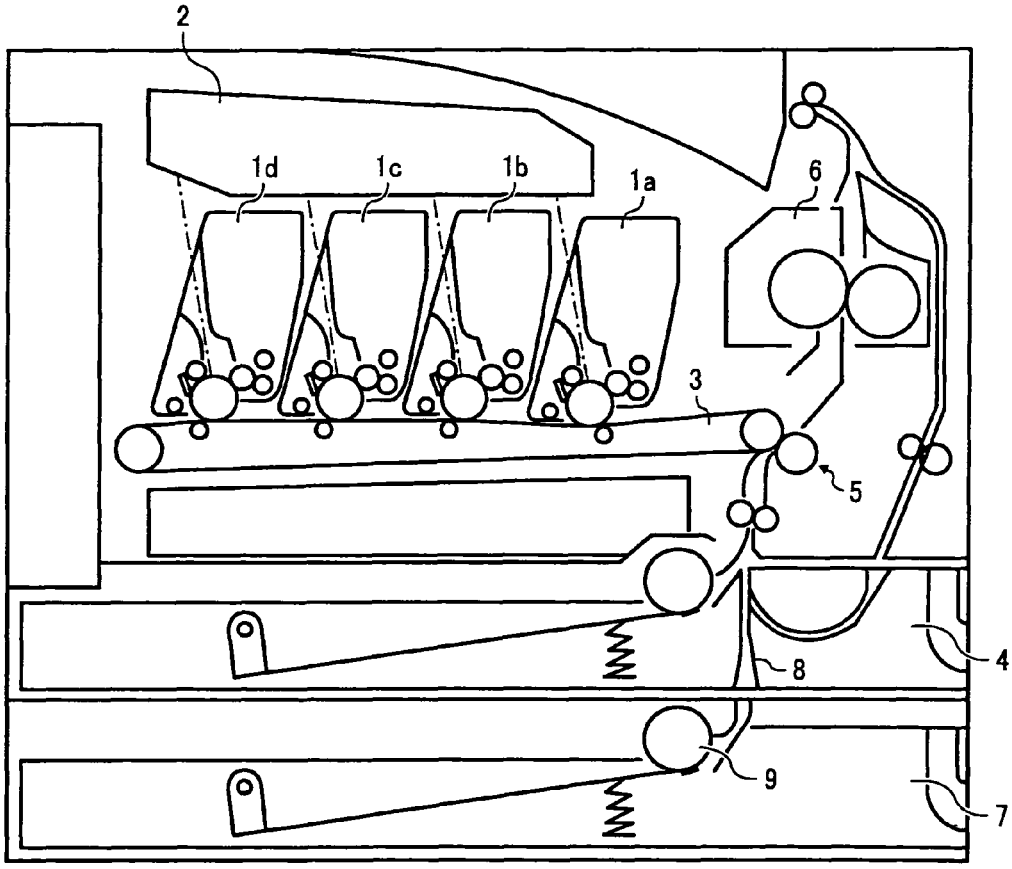
FIG. 1 is a schematic diagram of a typical electrophotographic color laser printer.

FIG. 1 is a schematic diagram of a general electrophotographic color laser printer. The color laser printer is provided with cyan, magenta, yellow, and black photosensitive units 1*a* to 1*d*, a writing unit 2, an intermediate transfer unit 3, a first paper cassette 4, a secondary transfer unit 5, a fusing unit 6, a second paper cassette 7, and the like, and capable of full-color printing. The second paper cassette 7 is supported by an additional paper-feed unit (not shown) that is removably positioned under a printer main body. Put another way, the color laser printer, serving as the image forming apparatus, is mounted on a top surface of the additional paper-feed unit. A paper guide 8 for transporting paper fed from the second paper cassette 7 by a paper feed roller 9 is constructed by utilizing a portion of the shape of the first paper cassette 4. In this configuration, a casing of the color laser printer and that of the additional paper-feed unit may be electrically connected by an automatic connecter. Such a connecting method facilitates user's installation of the additional paper-feed unit.

Figure 2:
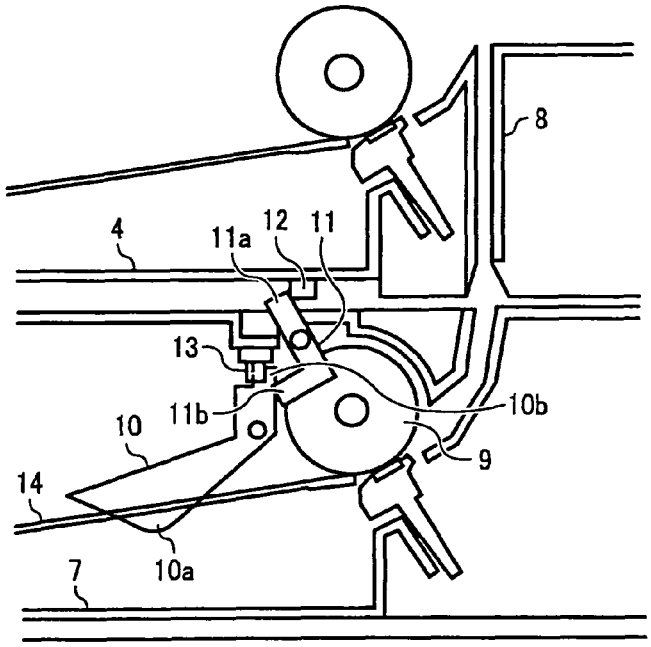
FIG. 2 is an enlarged view of relevant parts of a paper feeder according to a first embodiment of the present invention, depicting a state where no paper is loaded in a second paper cassette.

FIGS. 2 to 5 depict a paper feeder according to a first embodiment of the present invention, with emphasis on a paper detecting mechanism and a cassette detecting mechanism, which are relevant parts of the paper feeder. FIG. 2 depicts the paper feeder with no paper loaded in the second paper cassette 7. With reference to FIG. 2, a paper detecting lever 10 is rotatably supported by a pivot near an upper surface of paper in the second paper cassette 7 while being urged counterclockwise under its own weight. A detector 10*a*, which is a lower portion of the paper detecting lever 10, fits in a hole defined in a paper loading plate 14. A light shield 10*b*, which is an upper portion of the paper detecting lever 10, shields a detector of a transmission-type photosensor 13 serving as a displacement detecting sensor from light. The transmission-type photosensor 13 outputs an electrical signal in accordance with a state of the detector 10*a* of the paper detecting lever 10; i.e., a light-shielded or light-receiving state, thereby notifying a controller (not shown) of the state. In the following, the light-receiving state will be referred to as a "paper loaded" state, and the light-shielded state will be referred to as a "no paper loaded" state.

Figure 3:
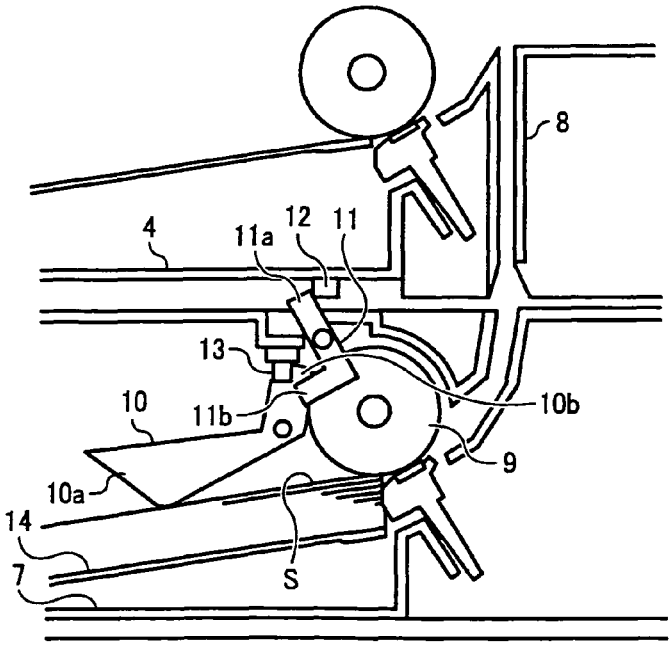
FIG. 3 is an enlarged view of the paper feeder according to the first embodiment, depicting a state where paper is loaded in the second paper cassette.

FIG. 3 depicts the paper feeder with paper loaded in the second paper cassette 7. In this state, the detector 10*a* of the paper detecting lever 10 comes into contact with the upper surface of the paper to thus be rotated clockwise. This brings the light shield 10*b* into a state of shielding the detector of the transmission-type photosensor 13 from light. A cassette detecting lever 11 is rotatably supported by a pivot above the second paper cassette 7 while being urged clockwise by an urging unit (not shown). In a state where the first paper cassette 4 is set at its working position, a detector 11*a*, which is an upper portion of the cassette detecting lever 11, comes into contact with a protrusion 12 on the first paper cassette 4, and a light shield 11*b*, which is a lower portion of the cassette detecting lever 11, is at a position of not shielding the detector of the transmission-type photosensor 13 from light.

Figure 4:
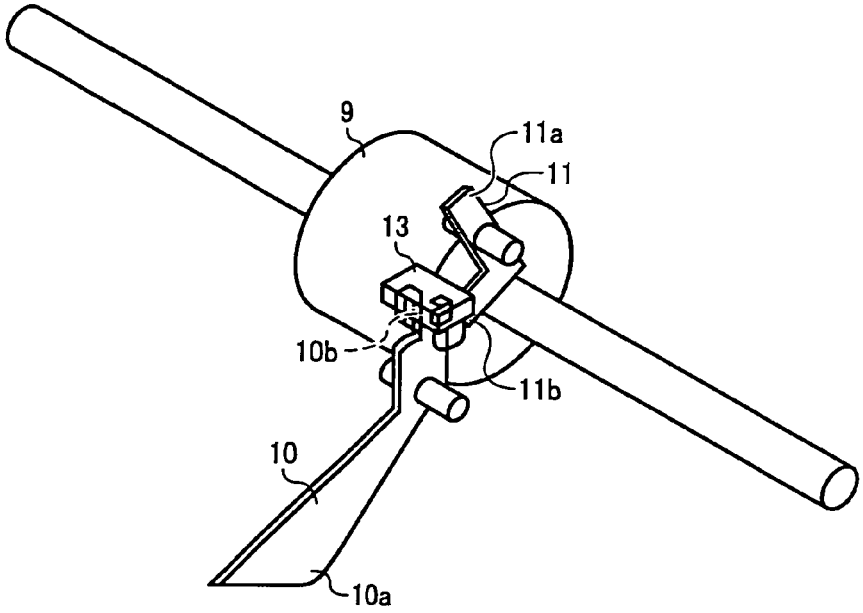
FIG. 4 is an exploded perspective partial view of a paper detecting lever, a cassette detecting lever, and a transmission-type photosensor in the state shown in FIG. 2, depicting a positional relationship thereamong.
Figure 5:
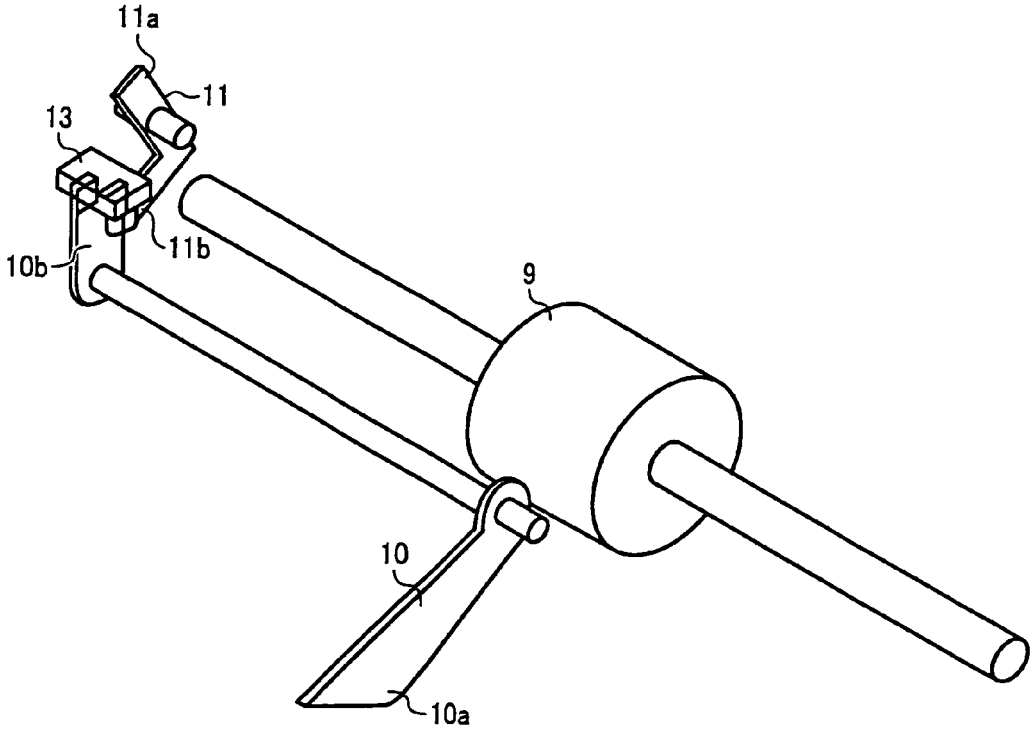
FIG. 5 is an exploded perspective view of a modification of the paper feeder of the first embodiment.

FIG. 4 depicts a positional relationship among the paper detecting lever 10, the cassette detecting lever 11, and the transmission-type photosensor 13 in the state shown in FIG. 2. Although FIG. 4 depicts an arrangement in which the paper detecting lever 10, the cassette detecting lever 11, and the transmission-type photosensor 13 are at an axially same position about an axis of the paper feed roller 9, the following arrangement shown in FIG. 5 can alternatively be employed. With reference to FIG. 5, the paper detecting lever 10 is divided into an upper portion and a lower portion, and the upper and lower portions are respectively fixed to opposite ends of a shaft parallel with the axial direction of the paper feed roller 9. The upper portion, the cassette detecting lever 11, and the transmission-type photosensor 13 are located at positions axially spaced from the lower portion.

Figure 6:
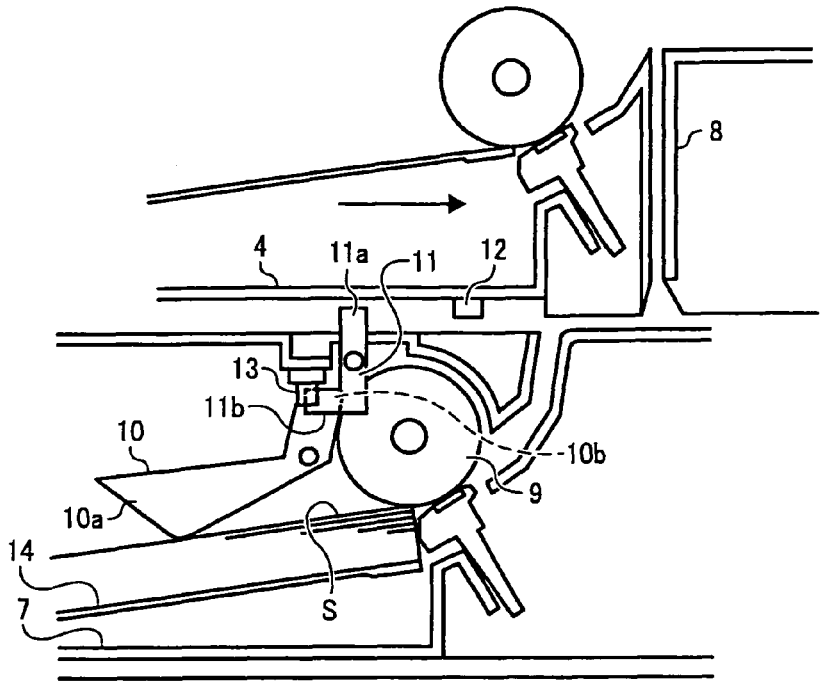
FIG. 6 is an enlarged view of the paper feeder shown in FIG. 3, depicting a state where a first paper cassette is pulled out rightward.

FIG. 6 depicts the paper feeder shown in FIG. 3 with the first paper cassette 4 pulled out rightward as indicated by an arrow. In this state, the urging unit urges the cassette detecting lever 11 to rotate clockwise, causing the light shield 11*b* to shield the detector of the transmission-type photosensor 13 from light.

In the state where the first paper cassette 4 is pulled out, the light shield 11*b* of the cassette detecting lever 11 constantly shields the transmission-type photosensor 13 from light irrespective of presence or absence of paper in the second paper cassette 7. Accordingly, a signal indicating the "no paper loaded" state is transmitted to the controller, and feeding of a sheet S from the second paper cassette 7 is disabled. Thus, prevention against undesirable feeding of the sheet S from the second paper cassette 7 with the first paper cassette 4 pulled out is attained without adding a sensor for detecting presence or absence of the first paper cassette 4. In addition, the number of parts required for transporting paper fed from the second paper cassette 7 is reduced, thereby allowing to provide products inexpensively.

Figure 7:
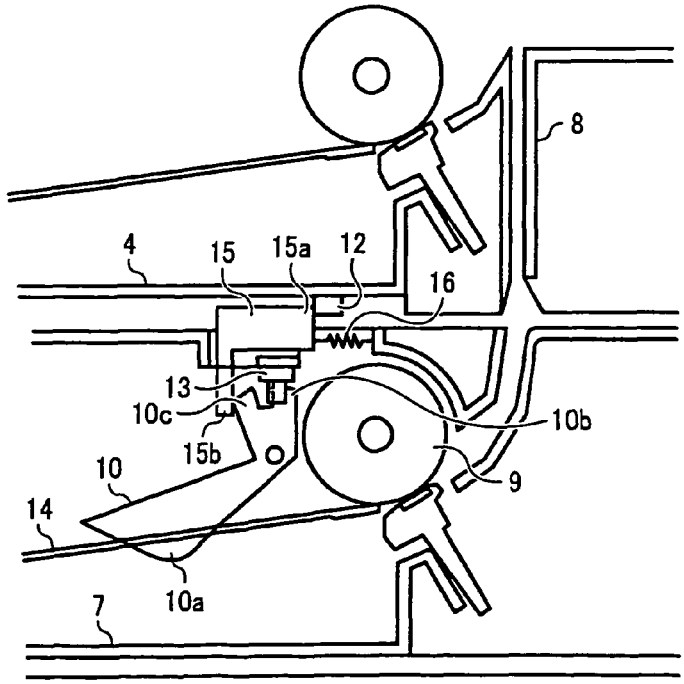
FIG. 7 is an enlarged view of relevant parts of a paper feeder according to a second embodiment of the present invention, depicting a state where no paper is loaded in a second paper cassette.
Figure 8:
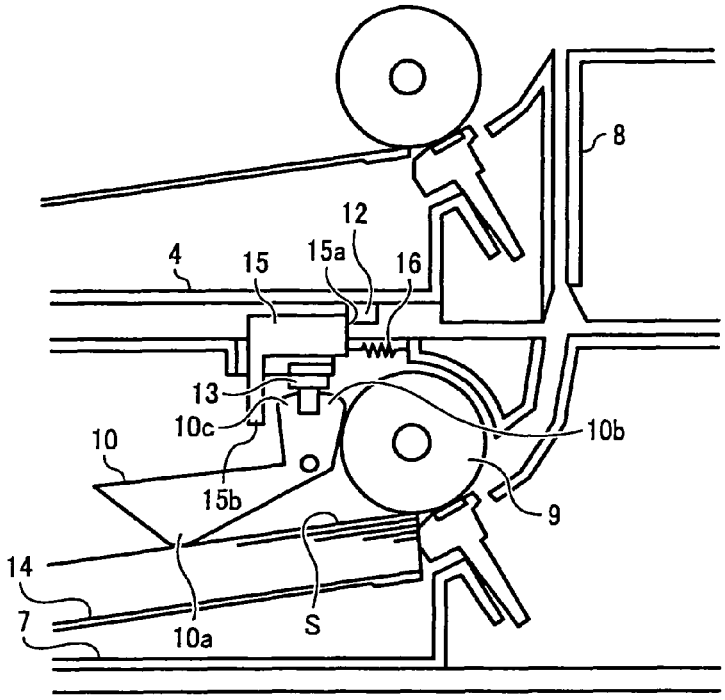
FIG. 8 is an enlarged view of the paper feeder according to the second embodiment, depicting a state where paper is loaded in the second paper cassette.
Figure 9:
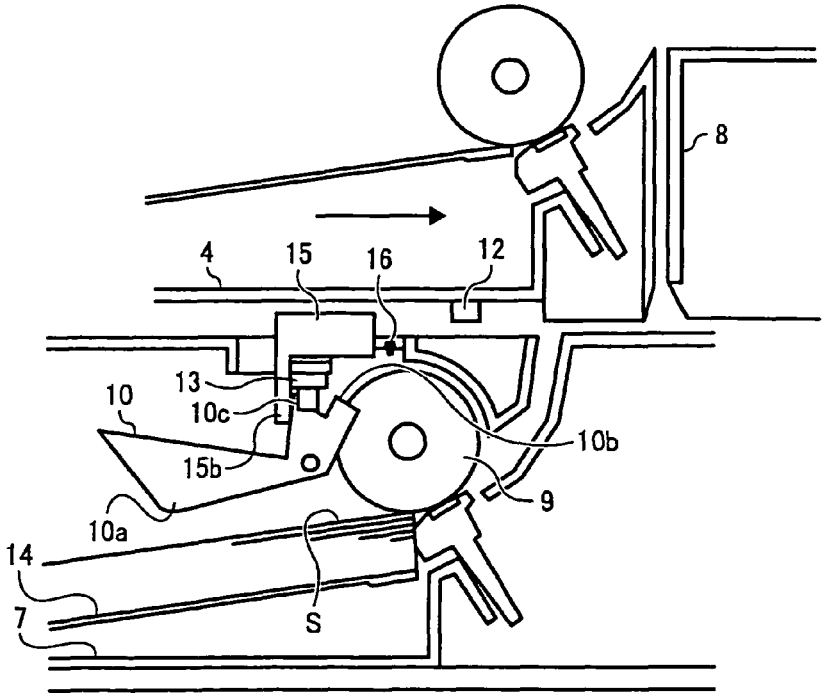
FIG. 9 is an enlarged view of the paper feeder shown in FIG. 8, depicting a state where a first paper cassette is pulled out rightward.

FIGS. 7 to 9 depict a paper feeder according to a second embodiment of the present invention, with emphasis on a paper detecting mechanism and a cassette detecting mechanism that are relevant parts of the paper feeder. FIG. 7 depicts the paper feeder with no paper loaded in the second paper cassette 7. With reference to FIG. 7, the paper detecting lever 10 is rotatably supported by the pivot near an upper surface of paper in the second paper cassette 7 while being urged counterclockwise under its own weight. The detector 10*a*, which is the lower portion of the paper detecting lever 10, fits in the hole defined in the paper loading plate 14. The light shield 10*b*, which is an upper portion of the paper detecting lever 10, shields the detector of the transmission-type photosensor 13 from light. The transmission-type photosensor 13 outputs an electrical signal in accordance with a state of the detector 10*a* of the paper detecting lever 10; i.e., the light-shielded or light-receiving state, thereby notifying the controller (not shown) of the state.

FIG. 8 depicts the paper feeder with paper loaded the second paper cassette 7. In this state, the detector 10*a* of the paper detecting lever 10 comes into contact with the upper surface of the paper to thus be rotated clockwise. This brings the light shield 10*b* and a light shield 10*c* into a state of not shielding the detector of the transmission-type photosensor 13 from light. A cassette detecting slider 15 is supported by a paper guide (not shown) above the second paper cassette 7 so as to be movable to the right and left while being urged rightward by an urging unit 16 such as a spring. In a state where the first paper cassette 4 is set at the working position, a detector 15*a*, which is an upper portion of the cassette detecting slider 15, comes into contact with the protrusion 12 on the first paper cassette 4, and a link portion (light shield) 15*b* of the cassette detecting slider 15 is separated from the paper detecting lever 10; that is, in a state of not shielding the detector of the transmission-type photosensor 13 from light.

FIG. 9 depicts the paper feeder shown in FIG. 8 with the first paper cassette 4 pulled out rightward as indicated by an arrow. In this state, the urging unit 16 urges the cassette detecting slider 15 to move rightward, and the link portion 15*b* causes the paper detecting lever 10 to rotate clockwise, and the light shield 10*c* shields the detector of the transmission-type photosensor 13 from light. The modification shown in FIG. 5 can be applied to the second embodiment as well.

According to the configuration, in the state where the first paper cassette 4 is pulled out, the link portion 15*b* of the cassette detecting slider 15 constantly shields the transmission-type photosensor 13 from light irrespective of the presence or absence of paper in the second paper cassette 7. Accordingly, a signal indicating the "no paper loaded" state is transmitted to the controller, and hence feeding of the sheet S from the second paper cassette 7 is disabled. Thus, prevention against undesirable feeding of the sheet S from the second paper cassette 7 with the first paper cassette 4 pulled out is attained without adding a sensor for detecting the presence or absence of the first paper cassette 4. In addition, the number of parts required for transporting paper fed from the second paper cassette 7 is reduced, thereby providing products inexpensively. Furthermore, according to this structure, only one component is required for shielding the transmission-type photosensor 13 from light. This allows to use a small and inexpensive sensor.

The configurations of the first and second embodiments are each effective for a structure in which the second paper cassette 7 is provided as an additional paper-feed unit separable from the printer main body. When such a structure is employed, a corresponding one of the cassette detecting lever 11 and the cassette detecting slider 15, the transmission-type photosensor 13, and the urging unit 16 are unnecessary when the additional paper-feed unit is not used. Accordingly, providing these components on the additional paper-feed unit attains reduction of cost for the printer main body, thereby providing products inexpensively.

Figure 10:
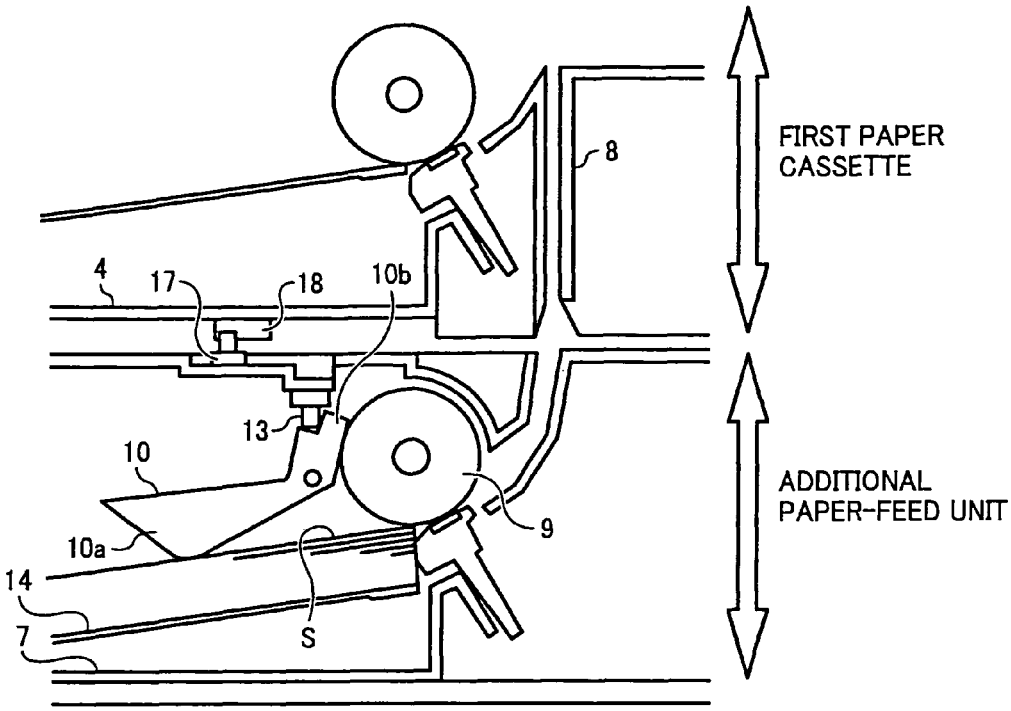
FIG. 10 is an enlarged view of relevant parts of a paper feeder according to a third embodiment of the present invention with a first paper cassette set at its working position.
Figure 11:
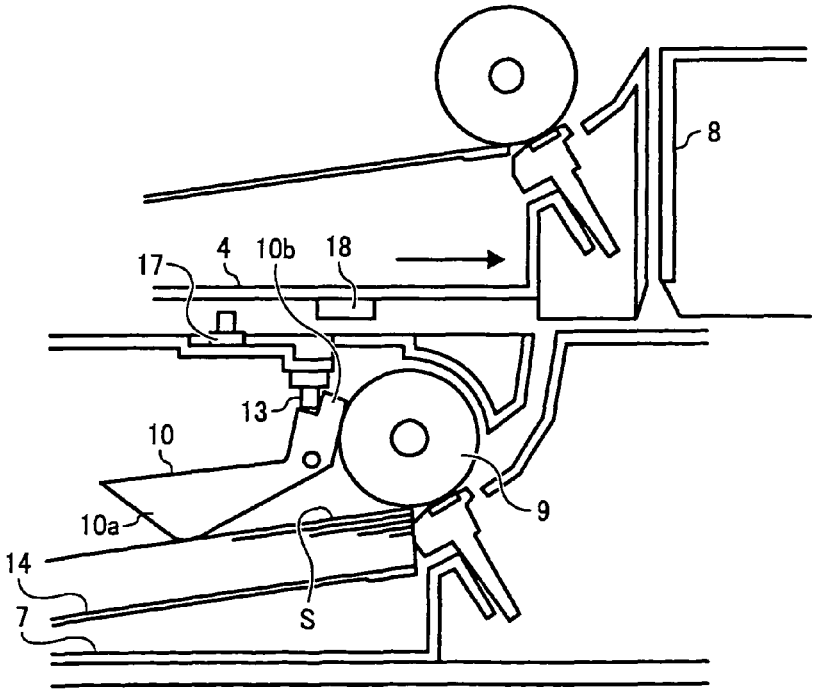
FIG. 11 is an enlarged view of the paper feeder according to the third embodiment, depicting a state where the first paper cassette is pulled out.

FIGS. 10 and 11 depict a paper feeder according to a third embodiment of the present invention, with emphasis on a paper detecting mechanism and a cassette detecting mechanism that are relevant parts of the paper feeder. FIG. 10 depicts the paper feeder with the first paper cassette 4 at its working position in the printer main body. A transmission-type photosensor 17 is arranged to project from an upper surface of the second paper cassette 7, which is the additional paper-feed unit. A cassette detecting rib 18 is formed on the first paper cassette 4 integrally therewith, and shields a detector of the transmission-type photosensor 17 from light. The transmission-type photosensor 17 outputs an electrical signal in accordance with a state of the cassette detecting rib 18; i.e., a light-shielded or light-receiving state, thereby notifying the controller (not shown) of the state. In the following, the light-receiving state will be referred to as a "cassette installed" state, and the light-shielded state will be referred to as a "cassette not installed" state.

FIG. 11 depicts the paper feeder shown in FIG. 10 with the first paper cassette 4 pulled out rightward as indicated by an arrow. In this state, the cassette detecting rib 18 is spaced from the detector of the transmission-type photosensor 17, and a signal indicating the "cassette not installed" state is transmitted to the controller. The modification shown in FIG. 5 can be applied to the third embodiment as well.

In the state where the first paper cassette 4 is pulled out, the transmission-type photosensor 17 is not shielded from light by the cassette detecting rib 18, which brings the transmission-type photosensor 17 into the light-receiving state. Accordingly, a signal indicating the "cassette not installed" state is transmitted to the controller, and hence feeding of the sheet S from the second paper cassette 7 is disabled. Thus, prevention against undesirable feeding of a sheet from the second paper cassette 7 with the first paper cassette 4 pulled out is attained. In addition, because the sensor for detecting the first paper cassette 4 is provided on the additional paper-feed unit, the number of parts of the printer main body is reduced, allowing to provide products inexpensively.

Further, it is also possible to convert the output signals of the transmission-type photosensor 13 and 17 through an AND circuit (not shown) into a paper-feed enabling signal, and transmits the signal to the controller. FIG. 12 is a table of inputs and outputs of the AND circuit. More specifically, as shown in FIG. 12, when the output signal of the transmission-type photosensor 13 indicates that the second paper cassette 7 is in the "no paper loaded" state and the output signal of the transmission-type photosensor 17 indicates that the first paper cassette 4 is in the "cassette not installed" state, feeding of the sheet S is disabled. When the output signal of the transmission-type photosensor 13 indicates that the second paper cassette 7 is in the "no paper loaded" state and the output signal of the transmission-type photosensor 17 indicates that the first paper cassette 4 is in the "cassette installed" state, feeding of the sheet S is disabled. When the output signal of the transmission-type photosensor 13 indicates that the second paper cassette 7 in the "paper loaded" state and the output signal of the transmission-type photosensor 17 indicates that the first paper cassette 4 is in the "cassette not installed" state, feeding of the sheet S is disabled. Only when the output signal of the transmission-type photosensor 13 indicates that the second paper cassette 7 is in the "paper loaded" state and the output signal of the transmission-type photosensor 17 indicates that the first paper cassette 4 is in the "cassette installed" state, feeding of the sheet S is enabled.

By thus converting the two signals into a signal, notification to the controller about the sheet-feeding enabled-or-disabled state is attained with the single signal. This reduction in the number of the input signal to the controller allows to provide products inexpensively. When the second paper cassette 7 is provided in the additional paper-feed unit, so long as the additional paper-feed unit is not attached to the printer main body, a jam of paper during a course of transportation from the second paper cassette 7 through the first paper cassette 4 to the secondary transfer unit (i.e., a paper jam that occurs when the paper guide 8 provided on the first paper cassette 4 to connect between the second paper cassette 7 to the transfer unit is removed or offset from position) cannot occur. Accordingly, the need of detecting the presence or absence of the first paper cassette 4 to prevent such a paper jam is eliminated. Also in this regard, providing the detector for detecting the presence or absence of the first paper cassette 4 on the additional paper-feed unit exerts a larger effect in terms of cost reduction than a configuration in which the detector is provided on the printer main body.

According to the third embodiment, the paper detecting lever 10 and the transmission-type photosensor 13 form a paper detector; and a corresponding one of the cassette detecting lever 11 and the cassette detecting slider 15, and the protrusion 12 form a signal switching unit; and the transmission-type photosensor 13 and the cassette detecting rib 19 form a cassette detector. However, each of the components can be replaced with its equivalent. The cassette detecting lever 11 and the cassette detecting slider 15 each is only an example cassette detecting member. The embodiments have been described about the configuration in which the transmission-type photosensor 13 and 17 are employed as the displacement detecting sensor. However, as a matter of course, the displacement detecting sensor is not limited to such a transmission-type photosensor. The embodiments have described about the shapes and the like of the paper detecting lever 10, the cassette detecting lever 11, the cassette detecting slider 15, and the cassette detecting rib 18, however, as a matter of course, they are only preferred examples and those of other shapes and the like can be employed.

According to an aspect of the present invention, it is possible simplify the structure by using the paper detecting lever and the displacement detecting sensor as the paper detector. Moreover, it is possible to prevent undesirable feeding of paper from the second paper cassette in the state where the first paper cassette is pulled out without adding a sensor for detecting the presence or absence of the first paper cassette. The invention also exerts other effects of reducing the number of parts required for transporting paper fed from the second paper cassette, thereby providing products inexpensively, as well as requiring only a displacement detecting sensor for detecting displacements of the cassette detecting member and the paper detecting lever.

Moreover, the first paper cassette acts on the paper detecting lever to thereby switch the signal. This allows to reduce the number of parts. Moreover, the first paper cassette acts on the displacement detecting sensor to thereby switch the signal. This allows to reduce the number of parts. Moreover, the second paper cassette is configured as an option unit optionally added to the image-forming-apparatus main body. This allows the second paper cassette to be installed as required by a user. Moreover, in the image forming apparatus according to another aspect, it is possible to reduce the number of parts when the additional paper-feed unit is to be installed.

Moreover, undesirable feeding of a sheet from the second paper cassette in the state where the first paper cassette is pulled out can be prevented. In addition, because the sensor for detecting the first paper cassette is provided on the additional paper feed unit, the number of parts of the image-forming-apparatus main body is reduced. This allows to provide products inexpensively.

Moreover, sheet feeding is enabled or disabled depending on a result of detection performed by the cassette detector of the first paper cassette. This allows to prevent occurrence of a paper jam due to removal of the first paper cassette. Moreover, output signals of the cassette detector and the paper detector are converted into a paper-feed enabling signal. This allows to reduce the number of signals transmitted to the controller, thereby providing products inexpensively.

As explained above, according to still another aspect of the present invention, the signal switching unit switches the signal to a signal indicating the "no paper loaded" state irrespective of the presence or absence of paper in the second paper cassette when the first paper cassette is pulled out. Put another way, the unit that detects whether the first paper cassette is pulled out can also be used for detection of whether paper is present in the second paper cassette. This can exerts an excellent effect of reducing the number of parts, thereby providing products inexpensively.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a first paper cassette supported on an image-forming-apparatus main body, the first paper cassette configured to be pulled out from a specific position within the image-forming apparatus;

a paper-feed unit connected to a lower portion of the image-forming-apparatus main body such that the paper feed unit can be detached from the lower portion of the image-forming apparatus main body, the paper feed unit including a second paper cassette, and a cassette detector on the paper-feed unit, the cassette detector configured to detect whether the first paper cassette is in the specific position if the paper-feed unit is connected to the lower portion of the image-forming-apparatus main body.

2. The image forming apparatus according to claim 1, wherein the paper-feed unit includes:

a paper detector that detects whether paper is present in the second paper cassette; and a controller that controls sheet feeding from the second paper cassette, wherein the controller enables sheet feeding from the second paper cassette to the image-forming-apparatus main body only when the cassette detector detects the first paper cassette and the paper detector detects a paper in the second paper cassette.

3. The image forming apparatus according to claim 2, wherein the cassette detector and the paper detector form an AND circuit, and notify the controller about whether sheet feeding is to be enabled or disabled with a single signal.

4. An image forming apparatus optional equipment comprising:

a paper-feed unit configured to be attached to and under the image forming apparatus, the paper-feed unit including, an auxiliary paper cassette configured to hold paper to be fed into the main body of the image forming apparatus;

a detector configured to detect if an image-forming-apparatus main body paper cassette is located at a specific position within the main body of the image forming apparatus, the detector configured to communicate a detection result to a control unit located in the main body of the image forming apparatus when the paper-feed unit is attached to the image forming apparatus.

5. A paper feed unit comprising:

a paper-feed unit body configured to be connected to a lower portion of an image-forming-apparatus main body such that the paper feed unit can be detached from the lower portion of the image-forming apparatus main body, the paper-feed unit configured to accept a paper-feed unit paper cassette, and a cassette detector on the paper-feed unit, the cassette detector configured to detect whether a second paper cassette is in a specific position if the paper-feed unit is connected to the lower portion of the image-forming-apparatus main body.

6. The paper feed unit of claim 5 further comprising:

the paper-feed unit paper cassette;

a paper detector that detects whether paper is present in the paper-feed unit paper cassette; and a controller that controls sheet feeding from the paper-feed unit paper cassette, wherein the controller enables sheet feeding from the second paper cassette to the image-forming-apparatus main body only when the cassette detector detects the first paper cassette and the paper detector detects a paper in the second paper cassette.

* * * * *